US007541787B2

(12) United States Patent
Hayashi et al.

(10) Patent No.: US 7,541,787 B2
(45) Date of Patent: Jun. 2, 2009

(54) TRANSISTOR DRIVE CIRCUIT, CONSTANT VOLTAGE CIRCUIT, AND METHOD THEREOF USING A PLURALITY OF ERROR AMPLIFYING CIRCUITS TO EFFECTIVELY DRIVE A POWER TRANSISTOR

(75) Inventors: Katsuhiro Hayashi, Mita (JP); Kohji Yoshii, Mita (JP)

(73) Assignee: Ricoh Company, Ltd., Tokyo (JP)

( * ) Notice: Subject to any disclaimer, the term of this patent is extended or adjusted under 35 U.S.C. 154(b) by 230 days.

(21) Appl. No.: 11/525,058

(22) Filed: Sep. 20, 2006

(65) Prior Publication Data

US 2007/0069819 A1 Mar. 29, 2007

(30) Foreign Application Priority Data

Sep. 21, 2005 (JP) ..... 2005-273560

(51) Int. Cl.
*G05F 1/575* (2006.01)

(52) U.S. Cl. ..... 323/281; 323/349

(58) Field of Classification Search ..... 323/273, 323/274, 281, 349
See application file for complete search history.

(56) References Cited

U.S. PATENT DOCUMENTS 4,598,243 A * 7/1986 Kawakami ..... 323/349
5,177,431 A * 1/1993 Smith et al. ..... 323/349
5,347,211 A * 9/1994 Jakubowski ..... 323/351
6,177,785 B1 * 1/2001 Lee ..... 323/281
6,894,470 B2 * 5/2005 Umemoto et al. ..... 323/281
7,068,019 B1 * 6/2006 Chiu ..... 323/281
7,196,504 B2 * 3/2007 Itoh ..... 323/280
7,245,465 B2 * 7/2007 Hikita ..... 361/18
7,388,356 B2 * 6/2008 Riehl ..... 323/281
2001/0011886 A1 * 8/2001 Kobayashi ..... 323/281
2004/0130305 A1 * 7/2004 Agari et al. ..... 323/282

* cited by examiner

*Primary Examiner*—Jeffrey L Sterrett
(74) *Attorney, Agent, or Firm*—Cooper & Dunham, LLP

(57) ABSTRACT

A transistor drive circuit, a constant voltage circuit, and a method thereof provided with a reference voltage generator, a power voltage detector, and a plurality of error amplifying circuits. The plurality of error amplifying circuits have different operational characteristics. One of the error amplifying circuits is selectively activated in response to a control signal in accordance with an operational mode selected. A reference voltage produced by the reference voltage generator or a divided voltage produced by the power voltage detector is also changed in response to the control signal suitably for each one of the plurality of error amplifying circuits which is selectively activated so as to control the power voltage generated by a power transistor to output a constant power voltage.

17 Claims, 7 Drawing Sheets

TRANSISTOR DRIVE CIRCUIT, CONSTANT VOLTAGE CIRCUIT, AND METHOD THEREOF USING A PLURALITY OF ERROR AMPLIFYING CIRCUITS TO EFFECTIVELY DRIVE A POWER TRANSISTOR

BACKGROUND

1. Field

The present disclosure relates to a transistor drive circuit, a constant voltage circuit, and a method thereof, and more particularly to a transistor drive circuit, a constant voltage circuit, and a method thereof capable of effectively generating a constant output voltage with a power transistor by using two or more error amplifying circuits.

2. Discussion of the Related-Art

A background related-art constant voltage circuit can be grouped into two types; a power supply circuit having a relatively greater current consumption with improvements in a ripple elimination ratio and load transient response characteristics and another power supply unit having a relatively small current consumption with an inferiority in response characteristics.

An apparatus such as a mobile cellular phone has a regular operation mode which operates with a regular current consumption and a standby mode (e.g., a sleep mode) which does not normally need a relatively high responsivity and consumes a relatively small amount of current. In such an apparatus, the constant voltage circuit has a problem of consuming a wasteful current in a standby mode which does not normally need a relatively high responsivity.

FIG. 1 illustrates one example of the background related-art constant voltage circuit introduced with an attempt to solve the above-mentioned problem. In FIG. 1, a constant voltage circuit 100 includes a reference voltage generator 102, an output voltage detector 103, a first error amplifying circuit 104, a second error amplifying circuit 105, an output transistor M101. The reference voltage generator 102 generates a reference voltage Vref. The output voltage detector 103 includes resistances R101 and R102 which are connected in series between an output terminal OUT and an earth ground. The output voltage detector 103 generates a voltage Vfb having a voltage value in proportion to an output voltage Vo. The first error amplifying circuit 104 has characteristics of a large current consumption and a faster responsivity. Contrary to it, the second error amplifying circuit 105 has characteristics of a small current consumption and a slow responsivity. The output transistor M101 is controlled by the first and second error amplifying circuits 104 and 105 to control the output voltage Vo to be a constant voltage.

A controller 100 connected to the first error amplifying circuit 104 starts and stops operations of the first error amplifying circuit 104. The controller 100 activates the first error amplifying circuit 104 to initiate an operation in the normal mode. Also, the controller 100 stops the first error amplifying circuit 104 and reduces an operative current of the first error amplifying circuit 104.

In the configuration of FIG. 1, the reference voltage Vref input to the first and second error amplifying circuits 104 and 105 is substantially equal to the voltage Vfb generated in proportion to the output voltage Vo. Therefore, if the first and second error amplifying circuits 104 and 105 have input offset voltages different from each other, the output voltage Vo may vary by a voltage value of Vdif*(Vo/Vfb) between a time when the first error amplifying circuit 104 is activated and a time when the second error amplifying circuit is activated.

Also, the output voltage Vo may vary if an amplifying ratio is different between the first and second error amplifying circuits 104 and 105.

SUMMARY

In view of the foregoing, the present patent specification describes a transistor drive circuit which is capable of effectively driving a power transistor to generate a constant power voltage by using two or more error amplifying circuits. In one example, a transistor drive circuit which drives a power transistor to output a power voltage from an output terminal and to control the power voltage to have a predefined voltage value, includes a reference voltage generator, a power voltage detector, and a plurality of error amplifying circuits. The reference voltage generator is configured to generate a reference voltage. The power voltage detector is configured to detect the power voltage output from the output terminal and to generate a divided voltage in proportion to the power voltage. Each of the plurality of error amplifying circuits is configured to be activated in response to a control signal input thereto to control an operation of the power transistor in a way such as to substantially equalize the divided voltage with the reference voltage. The plurality of error amplifying circuits have different operational characteristics. In such a transistor drive circuit, the power voltage detector is further configured to suitably change a proportionality constant of the divided voltage for each one of the plurality of error amplifying circuits which is selectively activated so as to control the power voltage generated by the power transistor to have the predefined power voltage.

In another example, a transistor drive circuit which drives a power transistor to output a power voltage from an output terminal and to control the power voltage to have a predefined voltage value, includes a reference voltage generator, a power voltage detector, and a plurality of error amplifying circuits. The reference voltage generator is configured to generate a reference voltage. The power voltage detector is configured to detect the power voltage output from the output terminal and to generate a divided voltage in proportion to the power voltage. Each of the plurality of error amplifying circuits is configured to be activated in response to a control signal input thereto to control an operation of the power transistor in a way such as to substantially equalize the divided voltage with the reference voltage. The plurality of error amplifying circuits have different operational characteristics. In such a transistor drive circuit, the reference voltage generator is further configured to suitably change a voltage value of the divided voltage for each one of the plurality of error amplifying circuits which is selectively activated so as to control the power voltage generated by the power transistor to have the predefined power voltage.

In another example, a transistor drive circuit which drives a power transistor to output a power voltage from an output terminal and to control the power voltage to have a predefined voltage value, includes a reference voltage generator, a power voltage detector, and a plurality of error amplifying circuits. The reference voltage generator is configured to generate a reference voltage. The power voltage detector is configured to detect the power voltage output from the output terminal and to generate a divided voltage in proportion to the power voltage. Each of the plurality of error amplifying circuits is configured to be activated in response to a control signal input thereto to control an operation of the power transistor in a way such as to substantially equalize the divided voltage with the reference voltage. The plurality of error amplifying circuits have different operational characteristics. In such a transistor drive circuit, the reference voltage generator is further configured to suitably change a voltage value of the reference voltage for each one of the plurality of error amplifying circuits which is selectively activated so as to control the power voltage generated by the power transistor to have the predefined power voltage.

Further, this patent specification describes a method of driving a power transistor which controls a current output from an input terminal to an output terminal in accordance with a signal input to a control electrode thereof. In one example, the method includes the steps of providing, activating, producing, generating, and controlling. The providing step provides a plurality of error amplifying circuits having different operational characteristics. The activating step activates one of the plurality of error amplifying circuits in response to a control signal input thereto to control an operation of the power transistor such that a voltage at the output terminal becomes a predefined power voltage. The producing step produces a reference voltage to the plurality of error amplifying circuits. The generating step generates a divided voltage in proportion to the voltage at the output terminal by using a proportionality constant in accordance with operational characteristics of each one of the plurality of error amplifying circuits. The controlling step controls the operation of the power transistor to substantially equalize the divided voltage with the reference voltage.

In another example, a method of driving a power transistor which controls a current output from an input terminal to an output terminal in accordance with a signal input to a control electrode thereof, includes the steps of providing, activating, producing, generating, and controlling. The providing step provides a plurality of error amplifying circuits having different operational characteristics. The activating step activates one of the plurality of error amplifying circuits in response to a control signal input thereto to control an operation of the power transistor such that a voltage at the output terminal becomes a predefined power voltage. The producing step produces a reference voltage for one of the plurality of error amplifying circuits which is selectively activated in accordance with the operational characteristics thereof. The generating step generates a divided voltage in proportion to the voltage at the output terminal by using a proportionality constant. The controlling step controls the operation of the power transistor to substantially equalize the divided voltage with the reference voltage.

In another example, a method of driving a power transistor which controls a current output from an input terminal to an output terminal in accordance with a signal input to a control electrode thereof, includes the steps of providing, activating, producing, generating, and controlling. The providing step provides a plurality of error amplifying circuits having different operational characteristics. The activating step activates one of the plurality of error amplifying circuits in response to a control signal input thereto to control an operation of the power transistor such that a voltage at the output terminal becomes a predefined power voltage. The producing step produces a reference voltage for each one of the plurality of error amplifying circuits in accordance with the operational characteristics thereof. The generating step generates a divided voltage in proportion to the voltage at the output terminal by using a proportionality constant. The controlling step controls the operation of the power transistor to substantially equalize the divided voltage with the reference voltage.

Further, this patent specification describes a constant voltage circuit which is capable of effectively generating a constant output voltage with a power transistor by using two or more error amplifying circuits, includes a power transistor, a reference voltage generator, a power voltage detector, and a plurality of error amplifying circuits. The power transistor is configured to output a power voltage from an output terminal and to control the power voltage to have a predefined voltage value. The reference voltage generator is configured to generate a reference voltage. The power voltage detector is configured to detect the power voltage output from the output terminal and to generate a divided voltage in proportion to the power voltage. Each of the plurality of error amplifying circuits is configured to be activated in response to a control signal input thereto to control an operation of the power transistor in a way such as to substantially equalize the divided voltage with the reference voltage. The plurality of error amplifying circuits have different operational characteristics. In such a constant voltage circuit, the power voltage detector is further configured to suitably change a proportionality constant of the divided voltage for each one of the plurality of error amplifying circuits which is selectively activated so as to control the power voltage generated by the power transistor to have the predefined power voltage.

In another example, a constant voltage circuit includes a power transistor, a reference voltage generator, a power voltage detector, and a plurality of error amplifying circuits. The power transistor is configured to output a power voltage from an output terminal and to control the power voltage to have a predefined voltage value. The reference voltage generator is configured to generate a reference voltage. The power voltage detector is configured to detect the power voltage output from the output terminal and to generate a divided voltage in proportion to the power voltage. Each of the plurality of error amplifying circuits is configured to be activated in response to a control signal input thereto to control an operation of the power transistor in a way such as to substantially equalize the divided voltage with the reference voltage. The plurality of error amplifying circuits have different operational characteristics. In such a constant voltage circuit, the reference voltage generator is further configured to suitably change a voltage value of the divided voltage for each one of the plurality of error amplifying circuits which is selectively activated so as to control the power voltage generated by the power transistor to have the predefined power voltage.

In another example, a constant voltage circuit includes a power transistor, a reference voltage generator, a power voltage detector, a plurality of error amplifying circuits. The power transistor is configured to output a power voltage from an output terminal and to control the power voltage to have a predefined voltage value. The reference voltage generator is configured to generate a reference voltage. The power voltage detector is configured to detect the power voltage output from the output terminal and to generate a divided voltage in proportion to the power voltage. Each of the plurality of error amplifying circuits is configured to be activated in response to a control signal input thereto to control an operation of the power transistor in a way such as to substantially equalize the divided voltage with the reference voltage. The plurality of error amplifying circuits having different operational characteristics. In such a constant voltage circuit, the reference voltage generator is further configured to suitably change a voltage value of the reference voltage for each one of the plurality of error amplifying circuits which is selectively activated so as to control the power voltage generated by the power transistor to have the predefined power voltage.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
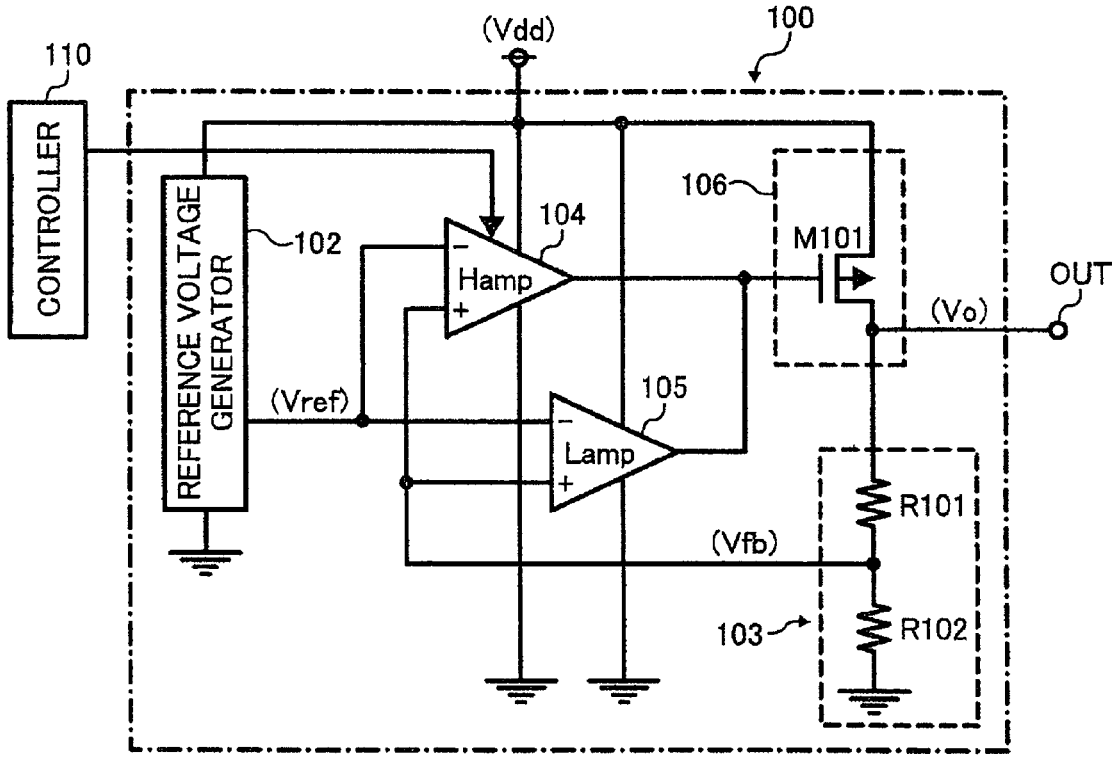
FIG. 1 PRIOR ART
FIG. 1 is a circuit diagram of a background constant voltage circuit.
Figure 2:
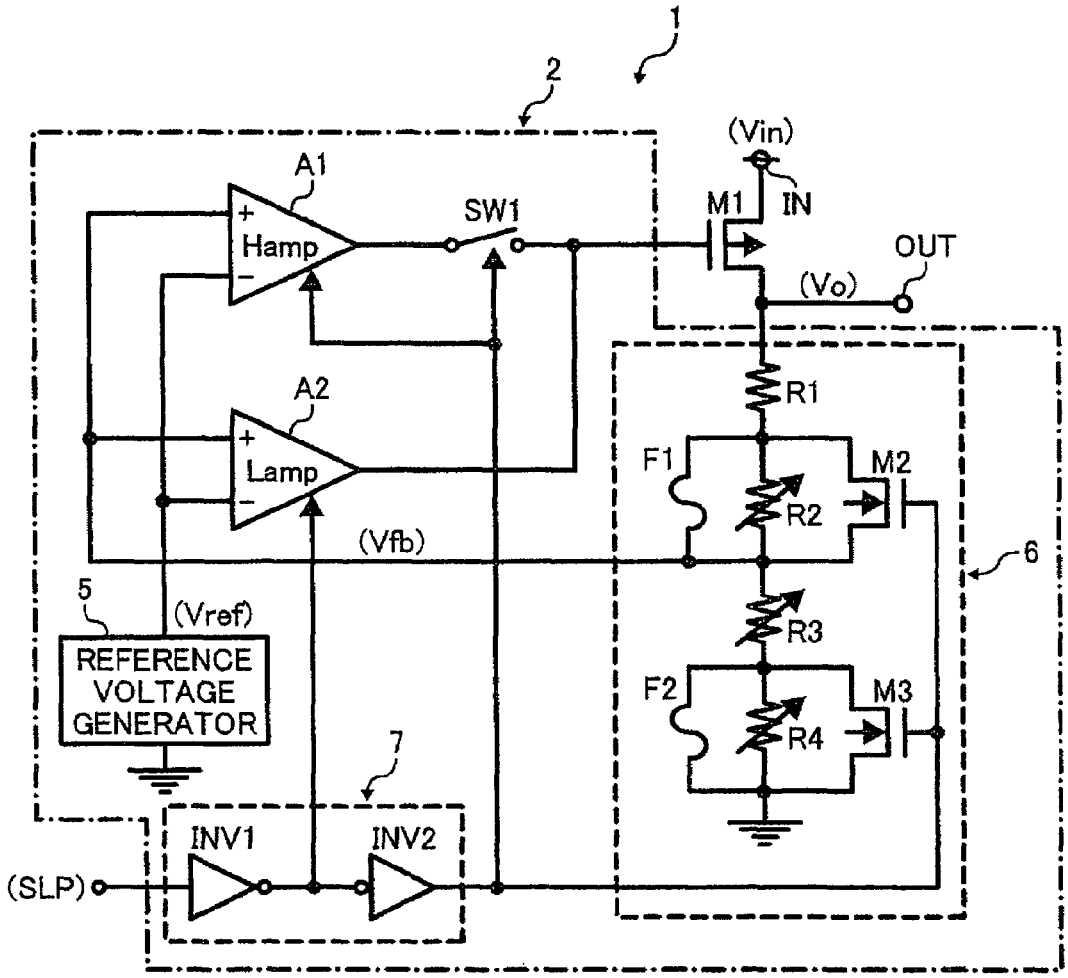
FIG. 2 is a circuit diagram of a constant voltage circuit according to an exemplary embodiment.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 2, a constant voltage circuit 1 according to an exemplary embodiment of the present disclosure is explained. As one example, the constant voltage circuit 1 of FIG. 2 uses a transistor drive circuit. In FIG. 2, the constant voltage circuit 1 receives an input voltage Vin through an input terminal IN, converts the input voltage Vin to an output voltage Vo having a specific voltage value, and outputs such an output voltage Vo through an output terminal OUT.

As illustrated in FIG. 2, the constant voltage circuit 1 includes an output transistor M1 and a transistor drive circuit 2. The output transistor M1 includes a PMOS (P-type metal oxide semiconductor) transistor and is configured to control a current output from the output terminal OUT in response to a signal receiving through a gate thereof. The transistor drive circuit 2 is configured to control operations of the output transistor M1 such that a voltage output from the output terminal OUT is set to a specific constant voltage.

It should be noted that an MOS transistor indicated as an NMOS transistor or a PMOS transistor denotes an enhancement-type MOS transistor, unless otherwise specified.

The transistor drive circuit 2 includes a reference voltage generator 5, an output voltage detector 6, a first error amplifying circuit A1, and a second error amplifying circuit A2. The reference voltage generator 5 is configured to generate a predetermined reference voltage Vref. The output voltage detector 6 is configured to detect the output voltage Vo and to divide it by a specific division ratio to generate a divided voltage Vfb. The first error amplifying circuit A1 has characteristics of faster operations with a relatively large current consumption, and is configured to control the operations of the output transistor M1 in such a way that the divided voltage Vfb becomes substantially equal to the reference voltage Vref. The second error amplifying circuit A2 has characteristics of a relatively low current consumption, and is configured to control the output transistor M1 also in such a way that the divided voltage Vfb becomes substantially equal to the reference voltage Vref.

The transistor drive circuit 2 further includes a switch SW1 and a control circuit 7. The switch SW1 is configured to connect and disconnect an output terminal of the first error amplifying circuit A1 to a gate of the output transistor M1. The control circuit 7 is configured to receive a sleep signal SLP from an external host apparatus (not shown) and to control operations of the first and second error amplifying circuits A1 and A2, the switch SW1, and the output voltage detector 6 in response to the sleep signal SLP.

The output voltage detector 6 includes resistances R1-R4, NMOS transistors M2 and M3, and fuses F1 and F2. Each of the resistances R2-R4 can be adjusted with trimming. The control circuit 7 includes inverters INV1 and INV2.

The output transistor M1 is connected between the input terminal IN and the output terminal OUT, and the resistances R1-R4 are connected in series between the output terminal OUT and a ground. The resistance R2 is connected in parallel to the NMOS transistor M2 and the fuse F1. The resistance R4 is connected in parallel to the NMOS transistor M3 and the fuse F2.

The divided voltage Vfb is output from a connection point between the resistances R2 and R3, and is input to a non-inverted input terminal of each of the first and second error amplifying circuits A1 and A2. The reference voltage Vref output from the reference voltage generator 5 is input to an inverted input terminal of each of the first and second error amplifying circuits A1 and A2. The output transistor M1 has a gate connected to an output terminal of the first error amplifying circuit A1 via the switch SW1, and to an output terminal of the second error amplifying circuit A2.

In the control circuit 7, the inverters INV1 and INV2 are connected in series to each other. The inverter INV1 has an input terminal to receive the sleep signal SLP, and an output terminal connected to a control-signal input terminal of the second error amplifying circuit A2 and an input terminal of the inverter INV2. The inverter INV2 has an output terminal connected to a control signal input terminal of the first error amplifying circuit A1, a control electrode of the switch SW1, and a gate of each of the NMOS transistors M2 and M3. Each of the first and second error amplifying circuits A1 and A2 starts an operation thereof upon receiving a high-leveled signal at the gate and stops the operation so as to reduce a current consumption upon receiving a low-leveled signal.

In the constant voltage circuit 1 having a structure as described above, each of the control signal input terminal of the first error amplifying circuit A1 and the control electrode of the switch SW1 receives a high-leveled signal so that the first error amplifying circuit A1 is turned into an activated state and the switch SW1 is turned on into a conductive state when the sleep signal SLP is a high-leveled signal. At this time, the second error amplifying circuit A2 receives a low-leveled signal at the control signal input terminal and stops its operations so as to cut off the current consumption. As a result, the output terminal of the second error amplifying circuit A2 is turned into a high impedance state. Also, each of the NMOS transistors M2 and M3 is turned on and therefore the output terminal OUT is connected to the ground only via the series resistances R1 and R3, regardless of states of the fuses F1 and F2. That is, the NMOS transistors M2 and M3 are used as switches. In this state, the output voltage Vo can be changed to a predetermined voltage by adjusting the divided voltage Vfb with a trimming of the resistance R3.

When the sleep signal SLP is at a low level, each of the control signal input terminal of the first error amplifying circuit A1 and the control electrode of the switch SW1 receives a low-leveled signal. Therefore, the first error amplifying circuit A1 stops its operation so as to cut off the current consumption. At the same time, each of the switch SW1 and the NMOS transistors M2 and M3 is turned off into a disconnection state. At this time, the second error amplifying circuit A2 receives a high level signal through the control signal input terminal thereof and is therefore in an active state. The resistances R2 and R4 are connected to the fuses F1 and F2, respectively, in parallel. Accordingly, in this condition, the divided voltage Vfb remains same as it is when the sleep signal SLP is at a high level.

If the first and second error amplifying circuits A1 and A2 have different offset voltages from each other, the output voltage Vo may differ by a voltage difference ΔVo between a time when the first error amplifying circuit A1 is activated and a time when the second error amplifying circuit A2 is activated. When a difference between the offset voltages of the first and second error amplifying circuits A1 and A2 is an offset voltage difference ΔVoff, the voltage difference ΔVo can be expressed as $$\Delta Vo=\Delta Voff*Vo/Vfb.$$

Based on this relationship, substantially accurate agreement can be made between values of the output voltage Vo when the first and second error amplifying circuits A1 and A2 are activated in the normal mode and the standby mode, respectively. Specifically, when ΔVo is negative, the output voltage Vo is increased to a voltage gained when the first error amplifying circuit A1 is selected, by way of cutting the fuse F1 and trimming the resistance R2. Also, when ΔVo is positive, the output voltage Vo is decreased to a voltage gained when the first error amplifying circuit A1 is selected, by way of cutting the fuse F2 and trimming the resistance R4.

In FIG. 2, the switch SW1 can be eliminated. This is possible in a particular case in which the output terminal of the first error amplifying circuit A1 falls into a high impedance state when the first error amplifying circuit A1 receives a low level signal at the control signal input terminal and consequently stops its operation. If the switch SW1 is eliminated, the output terminal of the first error amplifying circuit A1 is connected directly to the gate of the output transistor M1.

Figure 7:
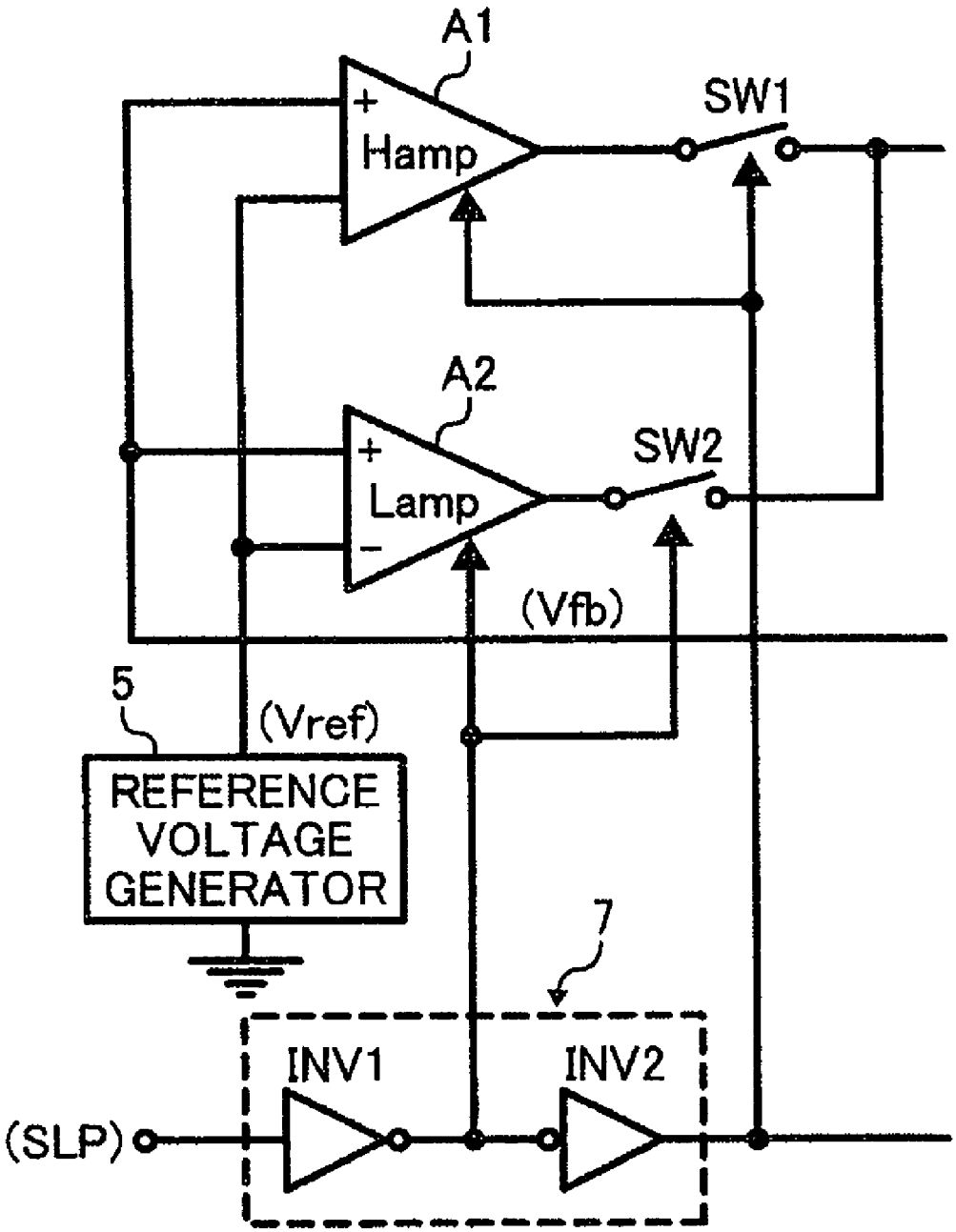
FIG. 7 is a circuit diagram in part of the constant voltage circuit of FIG. 2 with a modification by adding an extra switch according to another exemplary embodiment.

Another switch SW2 (see FIG. 7) similar to the switch SW1 may be added between the output terminal of the second error amplifying circuit A2 and the gate of the output transistor M1, with a connection between a control electrode of the extra switch and the output terminal of the inverter INV2. FIG. 7 is a circuit diagram in part of the constant voltage circuit of FIG. 2 with a modification by adding an extra switch according to another exemplary embodiment. This addition of the switch SW2 may be carried out in a particular case in which the output terminal of the second error amplifying circuit A2 does not fall into a high impedance state when the second error amplifying circuit A2 receives a low level signal at the control signal input terminal and consequently stops its operation. The thus-connected extra switch is turned on and becomes conductive when receiving a high level signal at the control electrode thereof.

Figure 3:
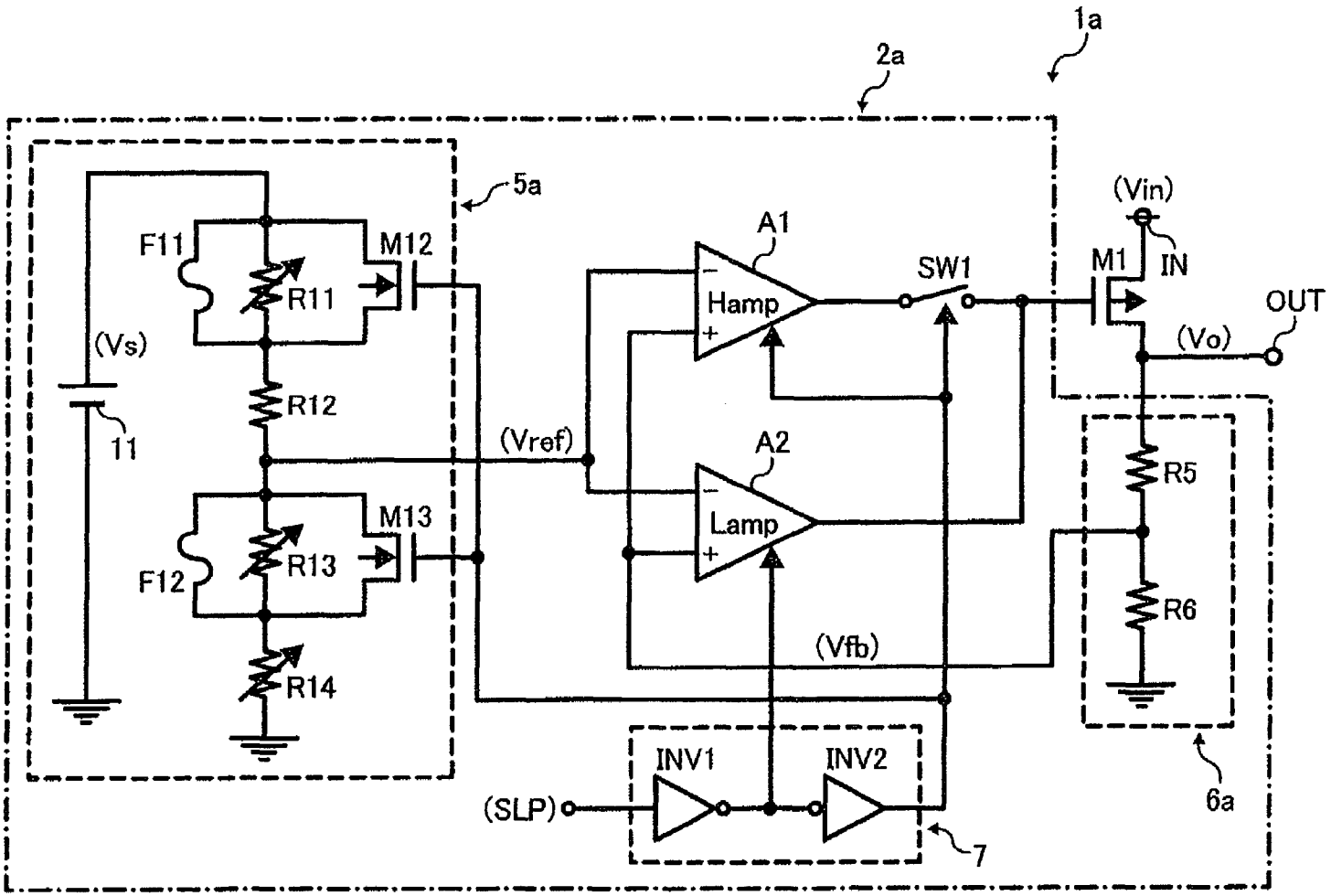
FIG. 3 is a circuit diagram of a constant voltage circuit according to another exemplary embodiment.

Referring to FIG. 3, a constant voltage circuit 1*a* according to another exemplary embodiment of the present disclosure is explained. The constant voltage circuit 1*a* of FIG. 3 uses a transistor drive circuit in a manner similar to the constant voltage circuit 1 of FIG. 2. The constant voltage circuit 1*a* is configured to substantially equalize the output voltage Vo generated when the first error amplifying circuit A1 is in operation with that generated when the second error amplifying circuit A2 is in operation. The constant voltage circuit 1*a* achieves this equalization by adjusting the reference voltage Vref, while the above-described constant voltage circuit 1 of FIG. 2 produces a similar effect by adjusting the divided voltage Vfb.

The constant voltage circuit 1*a* of FIG. 3 is similar to the constant voltage circuit 1 of FIG. 2, except for a transistor drive circuit 2*a* which is used in place of the transistor drive circuit 2 of FIG. 2. The transistor drive circuit 2*a* is similar to the transistor drive circuit 2 of FIG. 2, except for a reference voltage generator 5*a* and an output voltage detector 6*a*. The reference voltage generator 5*a* replaces the reference voltage generator 5 of FIG. 2, and the output voltage detector 6*a* replaces the output voltage detector 6 of FIG. 2.

In a manner similar to the constant voltage circuit 1 of FIG. 2, the constant voltage circuit 1*a* of FIG. 3 receives the input voltage Vin through the input terminal IN, converts the input voltage Vin to the output voltage Vo having a specific voltage value, and outputs such an output voltage Vo through the output terminal OUT.

The constant voltage circuit 1*a* of FIG. 3 is configured to use the transistor drive circuit 2*a* to control the operations of the output transistor M1 such that the voltage at the output terminal OUT is a predetermined voltage.

In the transistor drive circuit 2*a*, the reference voltage generator 5*a* generates and outputs the reference voltage Vref, and the output voltage detector 6*a* detects the output voltage Vo and divides it to generate the divided voltage Vfb.

The reference voltage generator 5*a* includes a constant voltage generator 11, resistances R11-R14, NMOS transistors M12 and M13, and fuses F11 and F12. The constant voltage generator 11 generates a constant voltage Vs. Each of the resistances R11, R13, and R14 can be adjusted with trimming. The output voltage detector 6*a* includes resistances R5 and F6.

The resistances R5 and R6 are connected in series between the output terminal OUT and the ground. The divided voltage Vfb is output from a connection point between the resistances R5 and R6. The divided voltage Vfb is input to each of the non-inverted input terminals of the first and second error amplifying circuits A1 and A2.

The resistances R11-R14 are connected in series between an output terminal of the constant voltage generator 11 generating the constant voltage Vs and the ground. The resistance R11 is connected in parallel to the NMOS transistor M12 and the fuse F11, and the resistance R13 is connected in parallel to the NMOS transistor M13 and the fuse F12. The reference voltage Vref is output from a connection point between the resistances R12 and R13, and is input to each of the non-inverted input terminals of the first and second error amplifying circuits A1 and A2. The inverter INV1 outputs a signal to the control signal input terminal. The inverter INV2 outputs a signal to the control signal input terminal of the first error amplifying circuit A1, the control electrode of the switch SW1, and each of the gates of the NMOS transistors M12 and M13.

In the above-described constant voltage circuit 1*a*, the first error amplifying circuit A1 falls into an active state and the switch SW1 is turned on and becomes conductive upon receiving the sleep signal SLP in a high level. At this time, the second error amplifying circuit A2 is caused to stop its operation so as to cut off the current consumption and makes the output terminal in a high impedance state. Also, each of the NMOS transistors M12 and M13 is turned on and therefore the output terminal of the constant voltage generator 11 generating the reference voltage Vs is connected to the ground only via the series resistances R12 and R14, regardless of states of the fuses F11 and F12. In this state, the output voltage Vo can be changed to a predetermined voltage by an adjustment of the reference voltage Vref with a trimming of the resistance R14.

When the sleep signal SLP is at a low level, each of the control signal input terminal of the first error amplifying circuit A1 and the control electrode of the switch SW1 receives a low-leveled signal. Therefore, the first error amplifying circuit A1 stops its operation so as to cut off the current consumption. At the same time, each of the switch SW1 and the NMOS transistors M12 and M13 is turned off into a disconnection state. At this time, the second error amplifying circuit A2 receives a high level signal through the control signal input terminal thereof and is therefore in an active state. The resistances R11 and R13 are connected to the fuses F11 and F12, respectively, in parallel. Accordingly, in this condition, the reference voltage Vref remains same as it is when the sleep signal SLP is at a high level.

If the first and second error amplifying circuits A1 and A2 have different offset voltages from each other, the output voltage Vo may differ by a voltage difference ΔVo between a time when the first error amplifying circuit A1 is activated and a time when the second error amplifying circuit A2 is activated. However, the output voltage Vo can be adjusted by changing the reference voltage Vref since the output voltage Vo is expressed as Vo=K*Vref, wherein K is a constant.

Based on this relationship, substantially accurate agreement can be made between values of the output voltage Vo when the first and second error amplifying circuits A1 and A2 are activated in the normal mode and the standby mode, respectively. Specifically, when ΔVo is negative, the reference voltage Vref is increased to a voltage gained when the first error amplifying circuit A1 is selected, by way of cutting the fuse F12 and trimming the resistance R13. Also, when ΔVo is positive, the reference voltage Vref is decreased to a voltage gained when the first error amplifying circuit A1 is selected, by way of cutting the fuse F11 and trimming the resistance R11.

Figure 4:
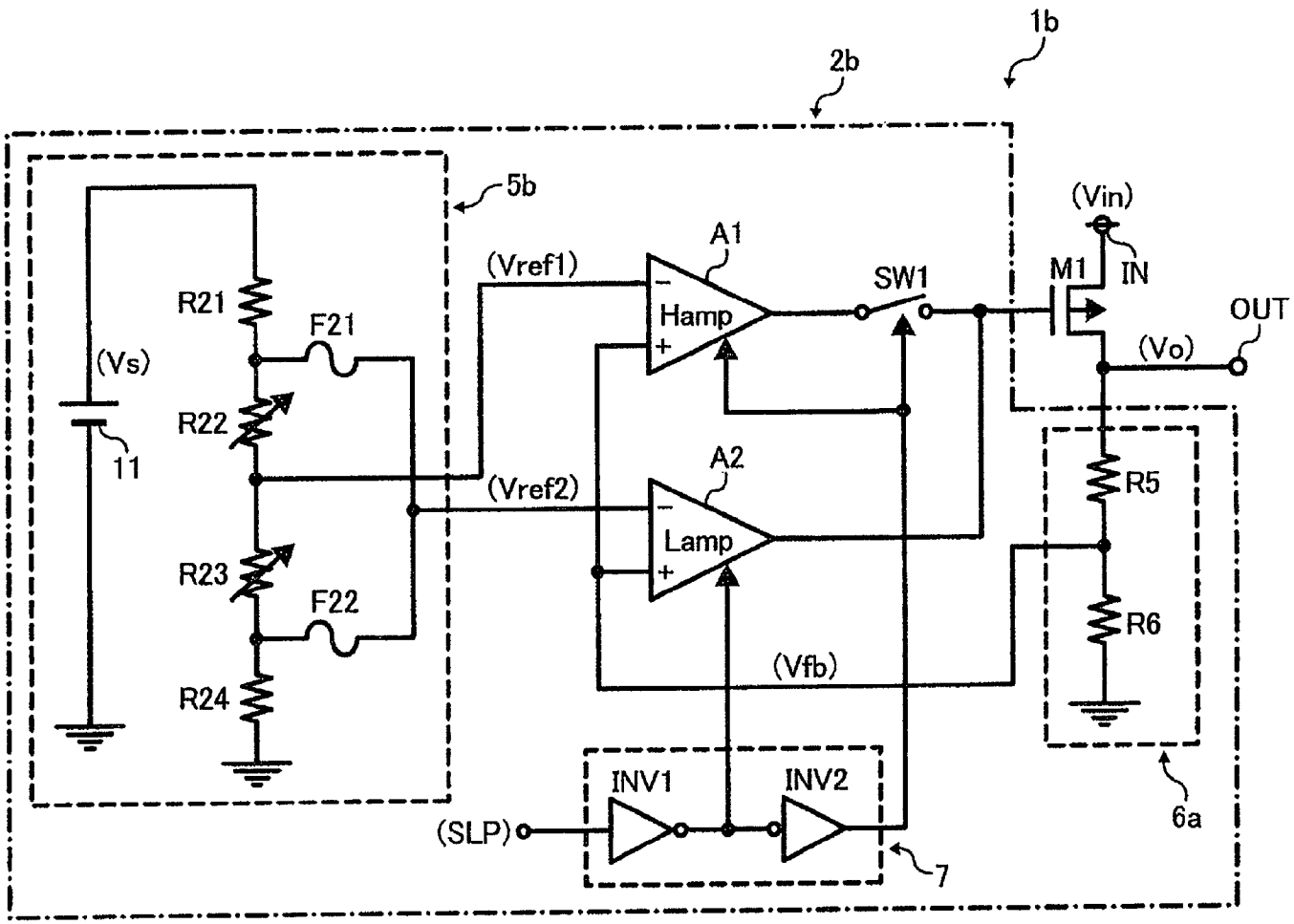
FIG. 4 is a circuit diagram of a constant voltage circuit according to another exemplary embodiment.

Referring to FIG. 4, a constant voltage circuit 1*b* according to another exemplary embodiment of the present disclosure is explained. The constant voltage circuit 1*b* of FIG. 4 uses a transistor drive circuit in a manner similar to the constant voltage circuit 1*a* of FIG. 3. The constant voltage circuit 1*b* is configured to input different reference voltages to the inverted input terminals of the first and second error amplifying circuits A1 and A2, while the constant voltage circuit 1*a* of FIG. 3 inputs a common voltage, or the reference voltage Vref.

The constant voltage circuit 1*b* of FIG. 4 is similar to the constant voltage circuit 1*a* of FIG. 3, except for a transistor drive circuit 2*b* which is used in place of the transistor drive circuit 2*a* of FIG. 3. The transistor drive circuit 2*b* is similar to the transistor drive circuit 2*a* of FIG. 3, except for a reference voltage generator 5*b*. The reference voltage generator 5*b* replaces the reference voltage generator 5*a* of FIG. 3.

In a manner similar to the constant voltage circuit 1*a* of FIG. 3, the constant voltage circuit 1*b* of FIG. 4 receives the input voltage Vin through the input terminal IN, converts the input voltage Vin to the output voltage Vo having a specific voltage value, and outputs such an output voltage Vo through the output terminal OUT.

The constant voltage circuit 1*b* of FIG. 4 is configured to use the transistor drive circuit 2*b* to control the operations of the output transistor M1 such that the voltage at the output terminal OUT is a predetermined voltage.

In the transistor drive circuit 2*b*, the reference voltage generator 5*b* generates and outputs first and second reference voltages Vref1 and Vref2, and the output voltage detector 6*a* detects the output voltage Vo and divides it to generate the divided voltage Vfb, as described above.

In the transistor drive circuit 2*b*, the first error amplifying circuit A1 has the characteristics of performing fast operations with a large current consumption, and controls the output transistor M1 such that the divided voltage Vfb is substantially equalized with the first reference voltage Vrefl. Also, the second error amplifying circuit A2 has the characteristics of suppressing a current consumption, and controls the output transistor M1 such that the divided voltage Vfb is substantially equalized with the second reference voltage Vref2.

Connections and functions of the switch SW1, the output voltage detector 6*a*, and the control circuit 7 are same as those of the constant voltage circuit 1*a* of FIG. 3.

The reference voltage generator 5*b* includes the constant voltage generator 11, resistances R21-R24, and fuses F21 and F22. The constant voltage generator 11 generates a constant voltage Vs, as described above. Each of the resistances R22 and R23 can be adjusted with trimming.

The resistances R21-R24 are connected in series between an output terminal of the constant voltage generator 11 having the constant voltage Vs and the ground. The resistances R22 and R23 have a connection point therebetween which is connected to the inverted input terminal of the first error amplifying circuit A1 to send the first reference voltage Vref1 thereto. The resistances R21 and R22 have a connection point therebetween which is connected via the fuse F21 to the inverted input terminal of the second error amplifying circuit A2 to send the second reference voltage Vref2 thereto. Also, the resistances R23 and R24 have a connection point therebetween which is connected via the fuse F22 to the inverted input terminal of the second error amplifying circuit A2 to send the second reference voltage Vref2 thereto.

With the above-described structure, the output voltage Vo generated during an operation of the first error amplifying circuit A1 with the sleep signal SLP at a high level may be greater than that generated during an operation of the second error amplifying circuit A2 with the sleep signal SLP at a low level. In this case, the output voltage Vo generated during an operation of the second error amplifying circuit A2 can be increased by increasing the second reference voltage Vref2. Specifically, the second reference voltage Vref2 can be made greater than the first reference voltage Vref1 by cutting off the fuse F22. The first and second reference voltages Vref1 and Vref2 can be adjusted by trimming the resistances R22 and R23.

On the contrary, the output voltage Vo generated during an operation of the first error amplifying circuit A1 with the sleep signal SLP at a high level may be smaller than that generated during an operation of the second error amplifying circuit A2 with the sleep signal SLP at a low level. In this case, the output voltage Vo generated during an operation of the second error amplifying circuit A2 can be decreased by decreasing the second reference voltage Vref2. Specifically, the second reference voltage Vref2 can be made smaller than the first reference voltage Vref1 by cutting off the fuse F21. The first and second reference voltages Vref1 and Vref2 can be adjusted by trimming the resistances R22 and R23.

In this way, the second reference voltage Vref2 can effectively be adjusted to eliminate an error of the output voltage Vo caused due to a difference of an offset voltage or an amplifying ratio between the first and second error amplifying circuits A1 and A2. As a result, the output voltage Vo generated during an operation of the first error amplifying circuit A1 can substantially be equalized with that generated during an operation of the second error amplifying circuit A2.

Figure 5:
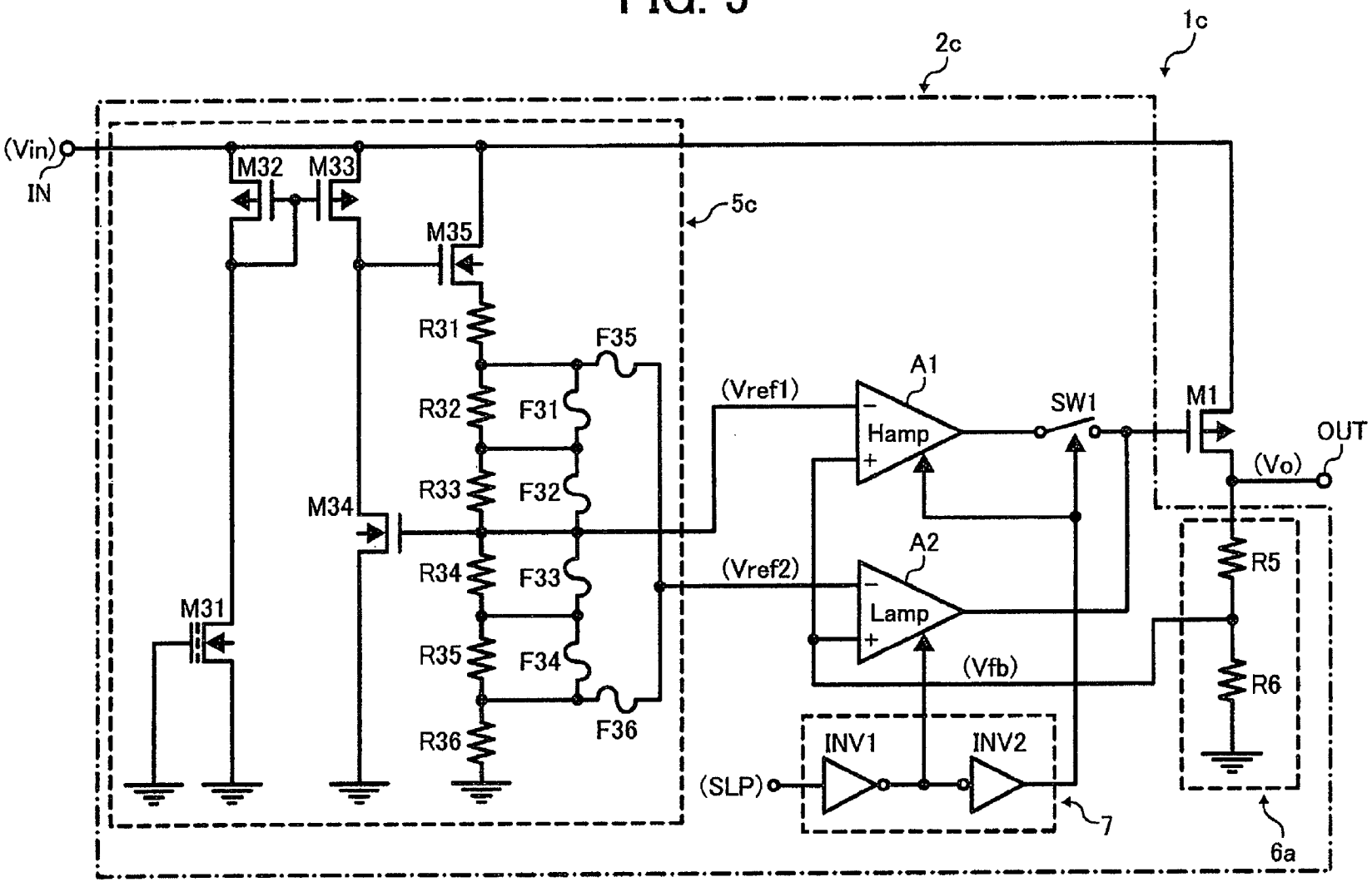
FIG. 5 is a circuit diagram of a constant voltage circuit according to another exemplary embodiment.

Referring to FIG. 5, a constant voltage circuit 1*c* according to another exemplary embodiment of the present disclosure is explained. The constant voltage circuit 1*c* of FIG. 5 uses a transistor drive circuit in a manner similar to the constant voltage circuit 1*b* of FIG. 4.

The constant voltage circuit 1*c* of FIG. 5 is similar to the constant voltage circuit 1*b* of FIG. 4, except for a transistor drive circuit 2*c* which is used in place of the transistor drive circuit 2*b* of FIG. 4. The transistor drive circuit 2*c* is similar to the transistor drive circuit 2*b* of FIG. 4, except for a reference voltage generator 5*c*. The reference voltage generator 5*c* replaces the reference voltage generator 5*b* of FIG. 4.

As illustrated in FIG. 5, the reference voltage generator 5*c* includes a delection-type NMOS transistor M31, PMOS transistors M32 and, M33, NMOS transistors M34 and M35, resistances R31-R36, and fuses F31-36. The PMOS transistors M32 and M33 form a current mirror circuit.

In the reference voltage generator 5*c*, the PMOS transistors M32 and M33 have sources connected to the input terminal IN and gates connected to each other and to a drain of the PMOS transistor M32. The deletion-type NMOS transistor M31 is connected between the drain of the PMOS transistor M32 and the ground, and has a gate connected to the ground. The deletion-type NMOS transistor M31 serves as a constant current source.

The NMOS transistor M34 is connected between the drain of the PMOS transistor M33 and the ground, and the drain of the PMOS transistor M33 is connected to a gate of the NMOS transistor M35. The NMOS transistor M35 has a drain connected to the input terminal IN and a source connected to the ground via the resistances R31-R36 in series. The resistances R32-R35 are connected in parallel to the fuses F31-F34, respectively. The fuse F35 is connected between a connection point of the resistances R31 and R32 and the inverted input terminal of the second error amplifying circuit A2. The fuse F36 is connected between a connection point of the resistances R35 and R36 and the inverted input terminal of the second error amplifying circuit A2. Thus, the second error amplifying circuit A2 is provided with the second reference voltage Vref2 through the inverted input terminal thereof. The resistance R33 has a connection point to the resistance R34, a gate of the NMOS transistor M34, and the inverted input terminal of the first error amplifying circuit A1. Thus, the first error amplifying circuit A1 is provided with the first reference voltage Vref1 through the inverted input terminal thereof.

In the constant voltage circuit 1*c* having the above-described structure, the gate and the source of the deletion-type NMOS transistor M31 are commonly connected to the ground, that is, the gate is provided with a bias of 0 and therefore a drain current of the deletion-type NMOS transistor M31 is constant. The drain current of the deleted-type NMOS transistor M31 flows becomes a drain current of the NMOS transistor M34 via the current mirror circuit formed by the PMOS transistors M32 and M33. When the constant drain current flows through the NMOS transistor M34, a gate voltage of the NOMS transistor M34 also becomes a constant voltage since the gate voltage is in proportion to the drain current. This constant gate voltage of the NMOS transistor M34 is the first reference voltage Vref1. The first and second reference voltages Vref1 and Vref2 are substantially the same until the fuses F31-F36 are cut off.

With the above-described structure, the output voltage Vo generated during an operation of the first error amplifying circuit A1 with the sleep signal SLP at a high level may be greater than that generated during an operation of the second error amplifying circuit A2 with the sleep signal SLP at a low level. In this case, the output voltage Vo generated during an operation of the second error amplifying circuit A2 can be increased by increasing the second reference voltage Vref2. Specifically, the second reference voltage Vref2 can be made greater than the first reference voltage Vref1 by cutting off the fuse F36 and at least one of the fuses F31 and F32.

On the contrary, the output voltage Vo generated during an operation of the first error amplifying circuit A1 with a high level of the sleep signal SLP may be smaller than that generated during an operation of the second error amplifying circuit A2 with a low level of the sleep signal SLP. In this case, the output voltage Vo generated during an operation of the second error amplifying circuit A2 can be decreased by decreasing the second reference voltage Vref2. Specifically, the second reference voltage Vref2 can be made smaller than the first reference voltage Vref1 by cutting off the fuse F35 and at least one of the fuses F33 and F34.

In this way, the second reference voltage Vref2 can effectively be adjusted to eliminate an error of the output voltage Vo caused due to a difference of an offset voltage or an amplifying ratio between the first and second error amplifying circuits A1 and A2. As a result, the output voltage Vo generated during an operation of the first error amplifying circuit A1 can substantially be equalized with that generated during an operation of the second error amplifying circuit A2.

The above descriptions explain examples of a transistor drive circuit including two error amplifying circuits, i.e., the first and second error amplifying circuits A1 and A2. The technical idea described above, however, can also be applied to a transistor drive circuit including more than two error amplifying circuits.

In addition, the switch SW1 can be eliminated from each of the constant voltage circuits 1*a*-1*c* of FIGS. 3-5. This is possible in a particular case in which the output terminal of the first error amplifying circuit A1 falls into a high impedance state when the first error amplifying circuit A1 receives a low level signal at the control signal input terminal and consequently stops its operation. If the switch SW1 is eliminated, the output terminal of the first error amplifying circuit A1 is connected directly to the gate of the output transistor M1.

Also, in each of the constant voltage circuits 1*a*-1*c* of FIGS. 3-5, the switch SW2 (see FIG. 7) similar to the switch SW1 may be added between the output terminal of the second error amplifying circuit A2 and the gate of the output transistor M1, with a connection between a control electrode of the extra switch and the output terminal of the inverter INV2. This addition of the extra switch SW2 may be carried out in a particular case in which the output terminal of the second error amplifying circuit A2 does not fall into a high impedance state when the second error amplifying circuit A2 receives a low level signal at the control signal input terminal and consequently stops its operation. The thus-connected extra switch is turned on and becomes conductive when receiving a high level signal at the control electrode thereof.

Figure 6:
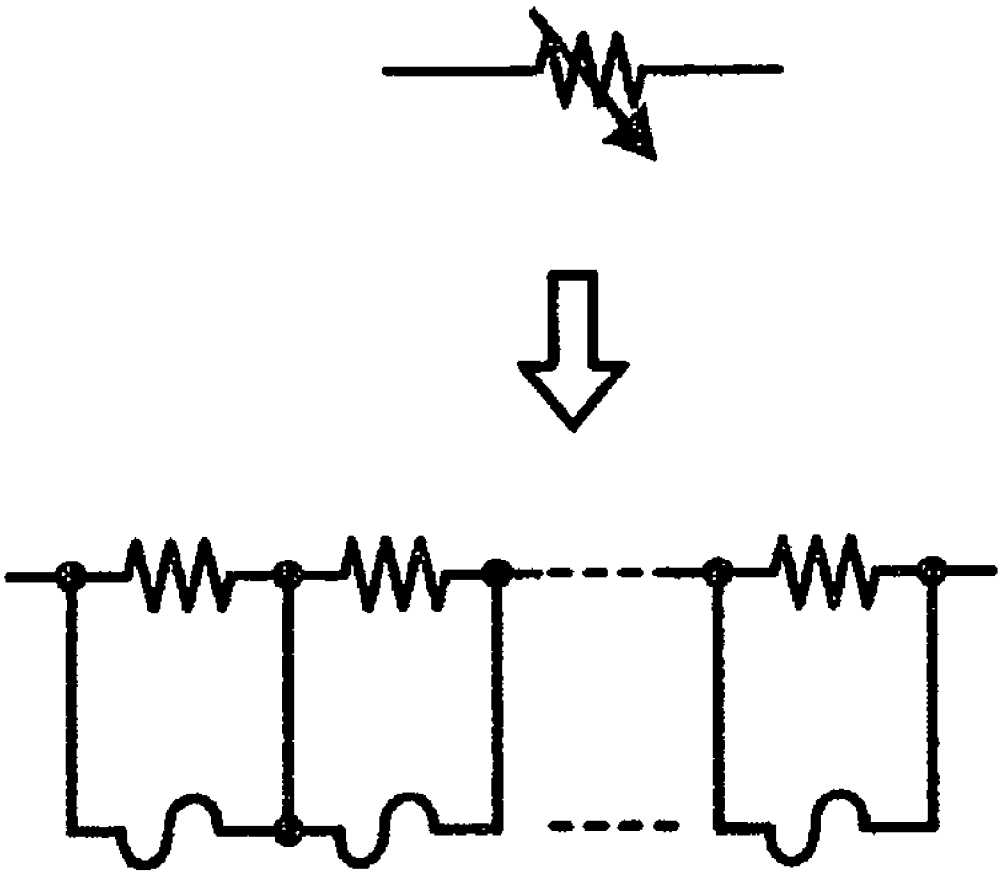
FIG. 6 is an illustration for explaining a resistance with a trimmer.

Furthermore, a resistance with a trimmer used in the above-described examples can be made by a plurality of series connected resistances with parallel connections to a plurality of fuses, as illustrated in FIG. 6. With this structure, a desired resistance value can be obtained by appropriately cutting off the fuses.

Numerous additional modifications and variations are possible in light of the above teachings. It is therefore to be understood that within the scope of the appended claims, the disclosure of this patent specification may be practiced otherwise than as specifically described herein. For example, elements and/or features of different examples and illustrative embodiments may be combined with each other and/or substituted for each other within the scope of this disclosure and appended claims.

This patent specification is based on Japanese patent application, No. JPAP2005-273560 filed on Sep. 21, 2005 in the Japan Patent Office, the entire contents of which are incorporated by reference herein.

What is claimed is:

1. A transistor drive circuit which drives a power transistor to output a power voltage from an output terminal and to control the power voltage to have a predefined voltage value, the circuit comprising:

a reference voltage generator configured to generate a reference voltage;

a power voltage detector configured to detect the power voltage output from the output terminal and to generate a divided voltage in proportion to the power voltage; and a plurality of error amplifying circuits each configured to be activated in response to a control signal input thereto to control an operation of the power transistor in a way such as to substantially equalize the divided voltage with the reference voltage, the plurality of error amplifying circuits having different operational characteristics, wherein the power voltage detector is further configured to suitably change a proportionality constant of the divided voltage for each one of the plurality of error amplifying circuits which is selectively activated so as to control the power voltage generated by the power transistor to have the predefined power voltage, and wherein said power voltage detector includes a first resistance connected to the output terminal;

a second resistance connected in series with the first resistance and configured to form a first series circuit with the first resistance;

a third resistance connected in series with the first and second resistances;

a fourth resistance connected in series with the first, second, and third resistances and a ground, and configured to form a second series circuit with the third resistance;

a first fuse connected in parallel to the second resistance;

a first switch connected in parallel to the second resistance;

a second fuse connected in parallel to the fourth resistance; and a second switch connected in parallel to the fourth resistance, wherein the second, third, and fourth resistances are variable with a trimmer, wherein the first and second series circuits have a connection point from which the divided voltage is output, and wherein each of the first and second switches performs a switching operation to change a proportionality constant of the divided voltage in accordance with the control signal input to the plurality of error amplifying circuits.

2. A constant voltage circuit, comprising:

a power transistor configured to output a power voltage from an output terminal and to control the power voltage to have a predefined voltage value;

a reference voltage generator configured to generate a reference voltage;

a power voltage detector configured to detect the power voltage output from the output terminal and to generate a divided voltage in proportion to the power voltage; and a plurality of error amplifying circuits each configured to be activated in response to a control signal input thereto to control an operation of the power transistor in a way such as to substantially equalize the divided voltage with the reference voltage, the plurality of error amplifying circuits having different operational characteristics, wherein the reference voltage generator is further configured to suitably change a voltage value of the reference voltage for each one of the plurality of error amplifying circuits which is selectively activated so as to control the power voltage generated by the power transistor to have the predefined power voltage, and wherein said reference voltage generator includes constant voltage generator configured to generate a constant voltage;

a first resistance connected with a point to which the constant voltage is supplied;

a second resistance connected in series with the first resistance and configured to form a first series circuit with the first resistance;

a third resistance connected in series with the first and second resistances;

a fourth resistance connected in series with the first, second, and third resistances and a ground, and configured to form a second series circuit with the third resistance;

a first fuse connected in parallel to the first resistance;

a first switch connected in parallel to the first resistance;

a second fuse connected in parallel to the third resistance; and a second switch connected in parallel to the third resistance, wherein the first, third, and fourth resistances are variable with a trimmer, wherein the first and second series circuits have a connection point from which the reference voltage is output, and wherein each of the first and second switches performs a switching operation to change a voltage value of the divided voltage in accordance with the control signal input to the plurality of error amplifying circuits.

3. The constant voltage circuit of claim 2, wherein the plurality of error amplifying circuits includes a first error amplifying circuit configured to be controlled in accordance with the control signal input thereto to control the power transistor in a way such that the divided voltage is equalized with the reference voltage, and a second error amplifying circuit configured to be controlled in accordance with the control signal input thereto to control the power transistor in a way such that the divided voltage is equalized with the reference voltage, the second error amplifying circuit having a smaller current consumption than the first error amplifying circuit, wherein one of the first and second error amplifying circuits is selectively activated in accordance with the control signal input thereto.

4. The constant voltage circuit of claim 3, further comprising:

a third switch connected between an output terminal of the first error amplifying circuit and a control electrode of the power transistor, having a control electrode to receive the control signal, and configured to control a transmission of an output voltage from the first error amplifying circuit to the power transistor in accordance with the control signal.

5. The constant voltage circuit of claim 4, further comprising;

a fourth switch connected between an output terminal of the second error amplifying circuit and the control electrode of the power transistor, having a control electrode to receive the control signal, and configured to control a transmission of an output voltage from the first error amplifying circuit to the power transistor in accordance with the control signal.

6. The constant voltage circuit of claim 2, wherein the power transistor, the reference voltage generator, the output voltage detector, and the plurality of error amplifying circuits are integrated into one integrated circuit chip.

7. A transistor drive circuit which drives a power transistor to output a power voltage from an output terminal and to control the power voltage to have a predefined voltage value, the circuit comprising:

a reference voltage generator configured to generate a reference voltage;

a power voltage detector configured to detect the power voltage output from the output terminal and to generate a divided voltage in proportion to the power voltage; and a plurality of error amplifying circuits each configured to be activated in response to a control signal input thereto to control an operation of the power transistor in a way such as to substantially equalize the divided voltage with the reference voltage, the plurality of error amplifying circuits having different operational characteristics, wherein the reference voltage generator is further configured to suitably change a voltage value of the reference voltage for each one of the plurality of error amplifying circuits which is selectively activated so as to control the power voltage generated by the power transistor to have the predefined power voltage, and wherein said reference voltage generator includes a constant voltage generator configured to generate a constant voltage;

a first resistance connected with a point to which the constant voltage is supplied;

a second resistance connected in series with the first resistance and configured to form a first series circuit with the first resistance;

a third resistance connected in series with the first and second resistances;

a fourth resistance connected in series with the first, second, and third resistances and a ground, and configured to form a second series circuit with the third resistance;

a first fuse connected in parallel to the first resistance;

a first switch connected in parallel to the first resistance;

a second fuse connected in parallel to the third resistance; and a second switch connected in parallel to the third resistance, wherein the first, third, and fourth resistances are variable with a trimmer, wherein the first and second series circuits have a connection point from which the reference voltage is output, and wherein each of the first and second switches performs a switching operation to change a voltage value of the divided voltage in accordance with the control signal input to the plurality of error amplifying circuits.

8. The transistor drive circuit of claim 7, wherein the plurality of error amplifying circuits includes a first error amplifying circuit configured to be controlled in accordance with the control signal input thereto to control the power transistor in a way such that the divided voltage is equalized with the reference voltage, and a second error amplifying circuit configured to be controlled in accordance with the control signal input thereto to control the power transistor in a way such that the divided voltage is equalized with the reference voltage, the second error amplifying circuit having a smaller current consumption than the first error amplifying circuit, wherein one of the first and second error amplifying circuits is selectively activated in accordance with the control signal input thereto.

9. The transistor drive circuit of claim 8, further comprising:

a third switch connected between an output terminal of the first error amplifying circuit and a control electrode of the power transistor, having a control electrode to receive the control signal, and configured to control a transmission of an output voltage from the first error amplifying circuit to the power transistor in accordance with the control signal.

10. The transistor drive circuit of claim 9, further comprising:

a fourth switch connected between an output terminal of the second error amplifying circuit and the control electrode of the power transistor, having a control electrode to receive the control signal, and configured to control a transmission of an output voltage from the second error amplifying circuit to the power transistor in accordance with the control signal.

11. The transistor drive circuit of claim 7, wherein the reference voltage generator, the output voltage detector, and the plurality of error amplifying circuits are integrated into one integrated circuit chip.

12. A method of driving a power transistor which controls a current output from an input terminal to an output terminal in accordance with a signal input to a control electrode thereof, the method comprising the steps of:

providing a plurality of error amplifying circuits having different operational characteristics;

activating one of the plurality of error amplifying circuits in response to a control signal input thereto to control an operation of the power transistor such that a voltage at the output terminal becomes a predefined power voltage;

producing a reference voltage to the plurality of error amplifying circuits;

utilizing a power voltage detector including a plurality of resistances and a plurality of fuses to generate a divided voltage in proportion to the voltage at the output terminal by using a proportionality constant in accordance with operational characteristics of each one of the plurality of error amplifying circuits; and controlling the operation of the power transistor to substantially equalize the divided voltage with the reference voltage; and changing the proportionality constant of the divided voltage by at least one of cutting one or more of said plurality of fuses and trimming one or more of said plurality of resistances so as to control the voltage at the output terminal to have the predefined power voltage, wherein said power voltage detector includes a first resistance connected to the output terminal;

a second resistance connected in series with the first resistance and configured to form a first series circuit with the first resistance;

a third resistance connected in series with the first and second resistances;

a fourth resistance connected in series with the first, second, and third resistances and a ground, and configured to form a second series circuit with the third resistance;

a first fuse connected in parallel to the second resistance;

a first switch connected in parallel to the second resistance;

a second fuse connected in parallel to the fourth resistance; and a second switch connected in parallel to the fourth resistance, wherein the second, third, and fourth resistances are variable with a trimmer, wherein the first and second series circuits have a connection point from which the divided voltage is output, and wherein each of the first and second switches performs a switching operation to change a proportionality constant of the divided voltage in accordance with the control signal input to the plurality of error amplifying circuits.

13. A method of driving a power transistor which controls a current output from an input terminal to an output terminal in accordance with a signal input to a control electrode thereof, the method comprising the steps of:

providing a plurality of error amplifying circuits having different operational characteristics;

activating one of the plurality of error amplifying circuits in response to a control signal input thereto to control an operation of the power transistor such that a voltage at the output terminal becomes a predefined power voltage;

utilizing a reference voltage generator including a plurality of resistances and a plurality of fuses to generate a reference voltage for one of the plurality of error amplifying circuits which is selectively activated in accordance with the operational characteristics thereof;

generating a divided voltage in proportion to the voltage at the output terminal by using a proportionality constant;

controlling the operation of the power transistor to substantially equalize the divided voltage with the reference voltage; and changing a voltage value of the divided voltage by at least one of cutting one or more of said plurality of fuses and trimming one or more of said plurality of resistances so as to control the voltage at the output terminal to have the predefined power voltage, wherein said reference voltage generator includes a constant voltage generator configured to generate a constant voltage;

a first resistance connected with a point to which the constant voltage is supplied;

a second resistance connected in series with the first resistance and configured to form a first series circuit with the first resistance;

a third resistance connected in series with the first and second resistances;

a fourth resistance connected in series with the first, second, and third resistances and a ground, and configured to form a second series circuit with the third resistance;

a first fuse connected in parallel to the first resistance;

a first switch connected in parallel to the first resistance;

second fuse connected in parallel to the third resistance; and a second switch connected in parallel to the third resistance, wherein the first, third, and fourth resistances are variable with a trimmer, wherein the first and second series circuits have a connection point from which the reference voltage is output, and wherein each of the first and second switches performs a switching operation to change a voltage value of the divided voltage in accordance with the control signal input to the plurality of error amplifying circuits.

14. A method of driving a power transistor which controls a current output from an input terminal to an output terminal in accordance with a signal input to a control electrode thereof, the method comprising the steps of:

providing a plurality of error amplifying circuits having different operational characteristics;

activating one of the plurality of error amplifying circuits in response to a control signal input thereto to control an operation of the power transistor such that a voltage at the output terminal becomes a predefined power voltage;

utilizing a reference voltage generator including a plurality of resistances and a plurality of fuses to generate a reference voltage for each one of the plurality of error amplifying circuits in accordance with the operational characteristics thereof;

generating a divided voltage in proportion to the voltage at the output terminal by using a proportionality constant;

controlling the operation of the power transistor to substantially equalize the divided voltage with the reference voltage; and changing a voltage value of the reference voltage by at least one of cutting one or more of said plurality of fuses and trimming one or more of said plurality of resistances so as to control the voltage at the output terminal to have the predefined power voltage, wherein said reference voltage generator includes a constant voltage generator configured to generate a constant voltage;

a first resistance connected with a point to which the constant voltage is supplied;

a second resistance connected in series with the first resistance and configured to form a first series circuit with the first resistance;

a third resistance connected in series with the first and second resistances;

a fourth resistance connected in series with the first, second, and third resistances and a ground, and configured to form a second series circuit with the third resistance;

a first fuse connected in parallel to the first resistance;

a first switch connected in parallel to the first resistance;

a second fuse connected in parallel to the third resistance; and a second switch connected in parallel to the third resistance, wherein the first, third, and fourth resistances are variable with a trimmer, wherein the first and second series circuits have a connection point from which the reference voltage is output, and wherein each of the first and second switches performs a switching operation to change a voltage value of the divided voltage in accordance with the control signal input to the plurality of error amplifying circuits.

15. A constant voltage circuit, comprising;

a power transistor configured to output a power voltage from an output terminal and to control the power voltage to have a predefined voltage value;

a reference voltage generator configured to generate a reference voltage;

a power voltage detector configured to detect the power voltage output from the output terminal and to generate a divided voltage in proportion to the power voltage; and a plurality of error amplifying circuits each configured to be activated in response to a control signal input thereto to control an operation of the power transistor in a way such as to substantially equalize the divided voltage with the reference voltage, the plurality of error amplifying circuits having different operational characteristics, wherein the power voltage detector is further configured to suitably change a proportionality constant of the divided voltage for each one of the plurality of error amplifying circuits which is selectively activated so as to control the power voltage generated by the power transistor to have the predefined power voltage, and wherein said power voltage detector includes a first resistance connected to the output terminal;

a second resistance connected in series with the first resistance and configured to form a first series circuit with the first resistance;

a third resistance connected in series with the first and second resistances;

a fourth resistance connected in series with the first, second, and third resistances and a ground, and configured to form a second series circuit with the third resistance;

a first fuse connected in parallel to the second resistance;

a first switch connected in parallel to the second resistance;

a second fuse connected in parallel to the fourth resistance; and a second switch connected in parallel to the fourth resistance, wherein the second, third, and fourth resistances are variable with a trimmer, wherein the first and second series circuits have a connection point from which the divided voltage is output, and wherein each of the first and second switches performs a switching operation to change a proportionality constant of the divided voltage in accordance with the control signal input to the plurality of error amplifying circuits.

16. A transistor drive circuit which drives a power transistor to output a power voltage from an output terminal and to control the power voltage to have a predefined voltage value, the circuit comprising;

a reference voltage generator configured to generate a reference voltage;

a power voltage detector configured to detect the power voltage output from the output terminal and to generate a divided voltage in proportion to the power voltage; and a plurality of error amplifying circuits each configured to be activated in response to a control signal input thereto to control an operation of the power transistor in a way such as to substantially equalize the divided voltage with the reference voltage, the plurality of error amplifying circuits having different operational characteristics, wherein the reference voltage generator is further configured to suitably change a voltage value of the divided voltage for each one of the plurality of error amplifying circuits which is selectively activated so as to control the power voltage generated by the power transistor to have the predefined power voltage, and wherein said reference voltage generator includes a constant voltage generator configured to generate a constant voltage;

a first resistance connected with a point to which the constant voltage is supplied;

a second resistance connected in series with the first resistance and configured to form a first series circuit with the first resistance;

a third resistance connected in series with the first and second resistances;

a fourth resistance connected in series with the first, second, and third resistances and a ground, and configured to form a second series circuit with the third resistance;

a first fuse connected in parallel to the first resistance;

a first switch connected in parallel to the first resistance;

a second fuse connected in parallel to the third resistance; and a second switch connected in parallel to the third resistance, wherein the first, third, and fourth resistances are variable with a trimmer, wherein the first and second series circuits have a connection point from which the reference voltage is output, and wherein each of the first and second switches performs a switching operation to change a voltage value of the divided voltage in accordance with the control signal input to the plurality of error amplifying circuits.

17. A constant voltage circuit, comprising;

a power transistor configured to output a power voltage from an output terminal and to control the power voltage to have a predefined voltage value;

a reference voltage generator configured to generate a reference voltage;

a power voltage detector configured to detect the power voltage output from the output terminal and to generate a divided voltage in proportion to the power voltage; and a plurality of error amplifying circuits each configured to be activated in response to a control signal input thereto to control an operation of the power transistor in a way such as to substantially equalize the divided voltage with the reference voltage, the plurality of error amplifying circuits having different operational characteristics, wherein the reference voltage generator is further configured to suitably change a voltage value of the divided voltage for each one of the plurality of error amplifying circuits which is selectively activated so as to control the power voltage generated by the power transistor to have the predefined power voltage, and wherein said reference voltage generator includes constant voltage generator configured to generate a constant voltage;

a first resistance connected with a point to which the constant voltage is supplied;

a second resistance connected in series with the first resistance and configured to form a first series circuit with the first resistance;

a third resistance connected in series with the first and second resistances;

a fourth resistance connected in series with the first, second, and third resistances and a ground, and configured to form a second series circuit with the third resistance;

a first fuse connected in parallel to the first resistance;

a first switch connected in parallel to the first resistance;

a second fuse connected in parallel to the third resistance; and a second switch connected in parallel to the third resistance, wherein the first, third, and fourth resistances are variable with a trimmer, wherein the first and second series circuits have a connection point from which the reference voltage is output, and wherein each of the first and second switches performs a switching operation to change a voltage value of the divided voltage in accordance with the control signal input to the plurality of error amplifying circuits.

* * * * *